US010753238B2

(12) United States Patent
Schmitt et al.

(10) Patent No.: US 10,753,238 B2
(45) Date of Patent: Aug. 25, 2020

(54) ROTOR PART OF A ROTOR FOR A CAMSHAFT ADJUSTER AND PRESSING TOOL FOR THE PRODUCTION THEREOF

(71) Applicant: GKN Sinter Metals Engineering GmbH, Radevormwald (DE)

(72) Inventors: Rainer Schmitt, Wachtberg (DE); Hasim Tekines, Wachtberg (DE); Sascha Frey, Troisdorf (DE); Ümit Aydin, Wachtberg (DE)

(73) Assignee: GKN Sinter Metals Engineering GmbH, Radevormwald (DE)

( * ) Notice: Subject to any disclaimer, the term of this patent is extended or adjusted under 35 U.S.C. 154(b) by 0 days.

(21) Appl. No.: 16/466,952

(22) PCT Filed: Dec. 1, 2017

(86) PCT No.: PCT/EP2017/081094
§ 371 (c)(1),
(2) Date: Jun. 5, 2019

(87) PCT Pub. No.: WO2018/104156
PCT Pub. Date: Jun. 14, 2018

(65) Prior Publication Data

US 2020/0072092 A1 Mar. 5, 2020

(30) Foreign Application Priority Data

Dec. 6, 2016 (DE) ..... 10 2016 123 580

(51) Int. Cl.
*F01L 1/344* (2006.01)
*B22F 3/03* (2006.01)

(52) U.S. Cl.
CPC ..... *F01L 1/3442* (2013.01); *B22F 3/03* (2013.01); *F01L 2103/01* (2013.01)

(58) Field of Classification Search
CPC ..... F01L 1/3442; F01L 2001/34423; F01L 2001/3445; F01L 1/46; F01L 2013/01; B22F 3/03
(Continued)

(56) References Cited

U.S. PATENT DOCUMENTS

2012/0214014 A1 8/2012 Schmitt et al.
2012/0216654 A1 8/2012 Schmitt et al.
(Continued)

FOREIGN PATENT DOCUMENTS

DE 102015204754 A1 9/2016
JP 2000145414 A 5/2000
WO 2004112996 A1 12/2004

OTHER PUBLICATIONS

PCT International Search Report and Written Opinion, PCT/EP2017/081094, Feb. 26, 2018, 21 pages.

*Primary Examiner* — Jorge L Leon, Jr.
(74) *Attorney, Agent, or Firm* — Quarles & Brady LLP

(57) ABSTRACT

The invention relates to a first rotor part for a camshaft adjuster, wherein the first rotor part is configured in the form of a disc, and wherein the first rotor part has an encircling shoulder in a circumferential direction, said shoulder extending in a first axial direction beyond the first end side, wherein the first rotor part has at least one inner first opening which is arranged on the first inner casing on that side of the shoulder that is remote from the first end side and which is connected to the first end side via a first fluid duct which extends outwards in the radial direction from the shoulder through the first rotor part; wherein the first rotor part is produced in one part by powder metallurgy with all the inner first openings and first fluid ducts and the shoulder. The invention also relates to a pressing tool for producing a first rotor part.

14 Claims, 6 Drawing Sheets

Figure 5:
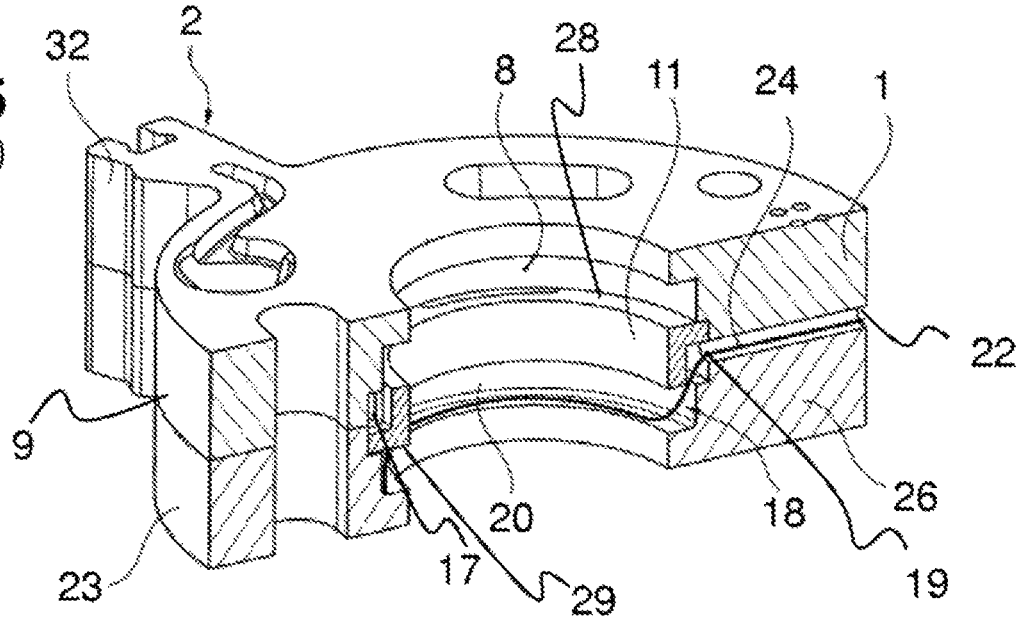
Fig. 5 (Prior Art)

(58) Field of Classification Search
USPC ..... 123/90.17
See application file for complete search history.

(56) References Cited

U.S. PATENT DOCUMENTS

| | | | | |
|---|---|---|---|---|
| 2014/0238325 | A1 | 8/2014 | Frey | |
| 2016/0237861 | A1 | 8/2016 | Schmitt et al. | |
| 2016/0305291 | A1* | 10/2016 | Weber | F01L 1/3442 |
| 2016/0305292 | A1* | 10/2016 | Weber | F01L 1/3442 |

* cited by examiner

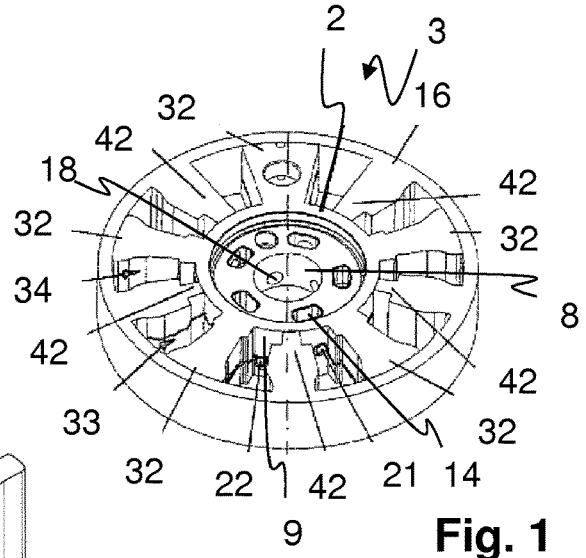
Fig. 1
(Prior Art)
Fig. 2
(Prior Art)
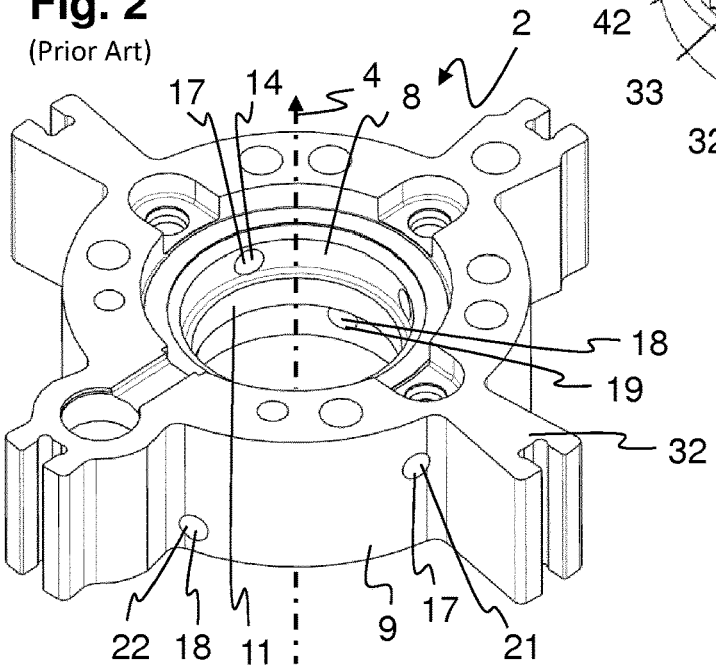
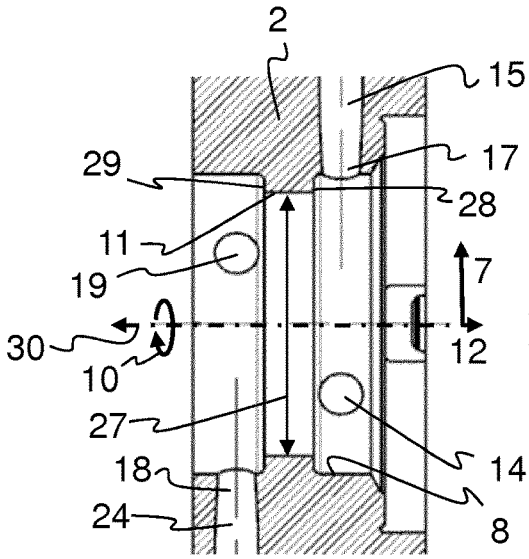
Fig. 4
(Prior Art)
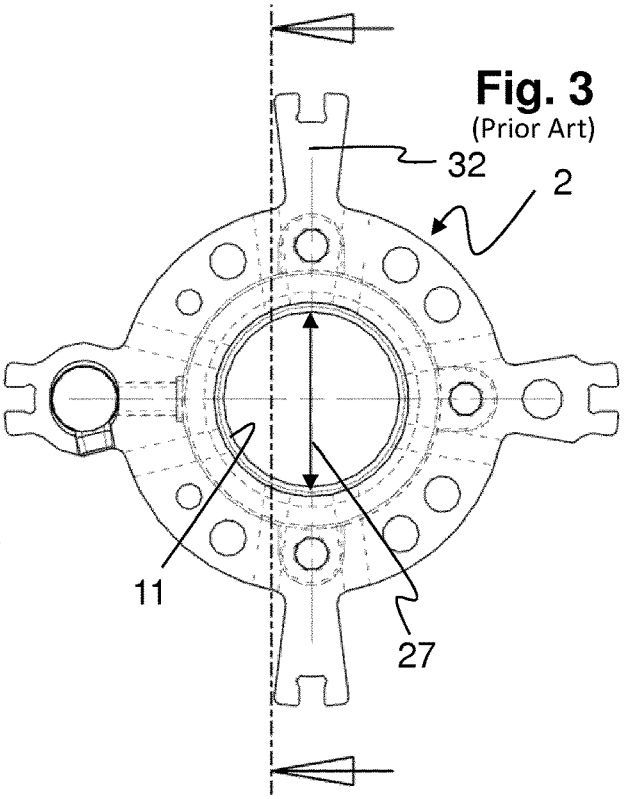
Fig. 3
(Prior Art)

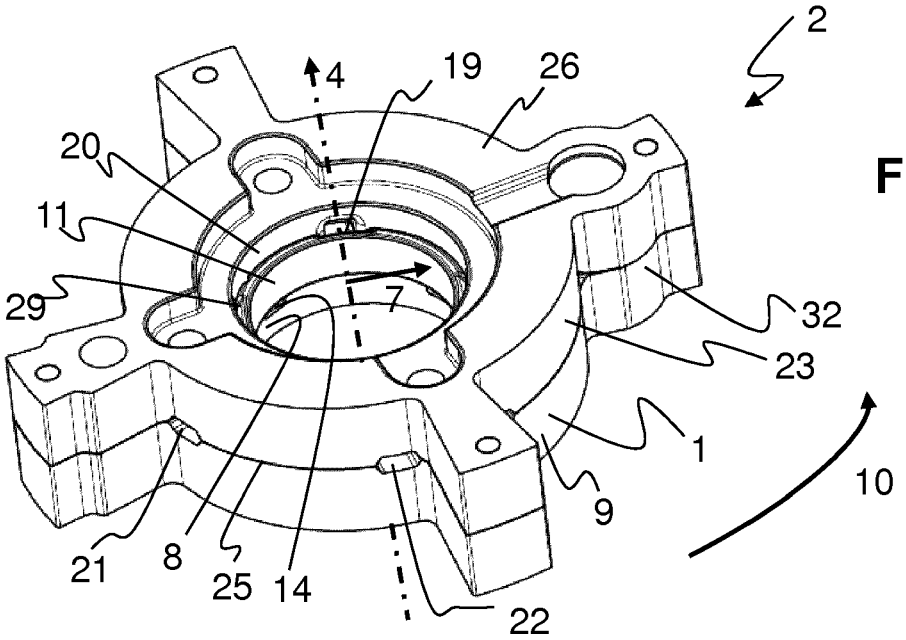
Fig. 7
Fig. 8
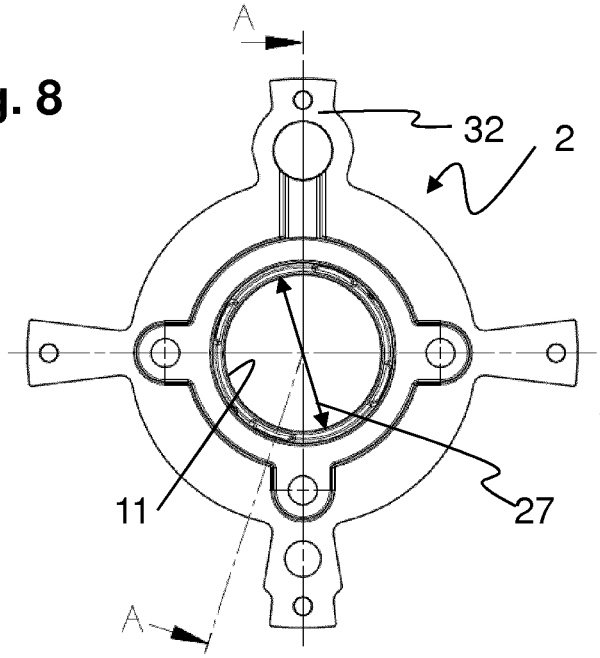
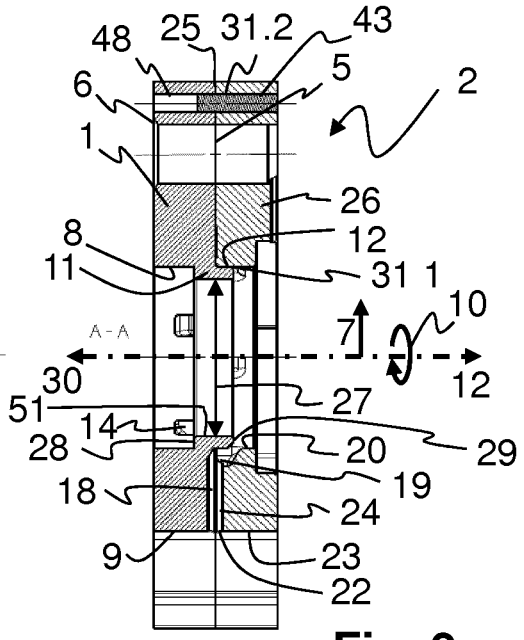
Fig. 9

Fig. 12
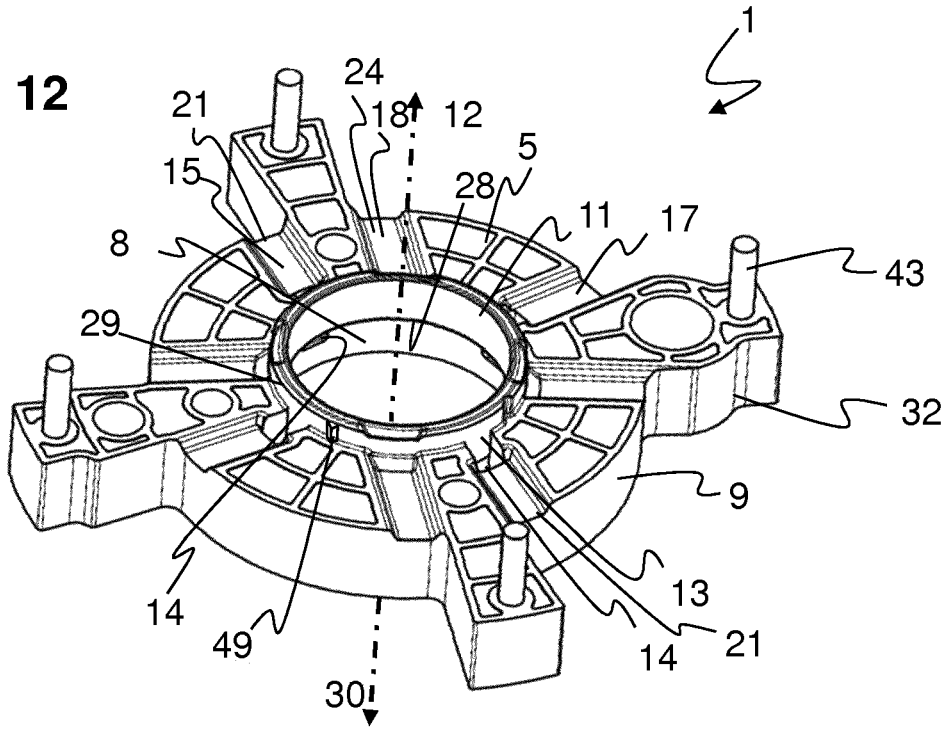
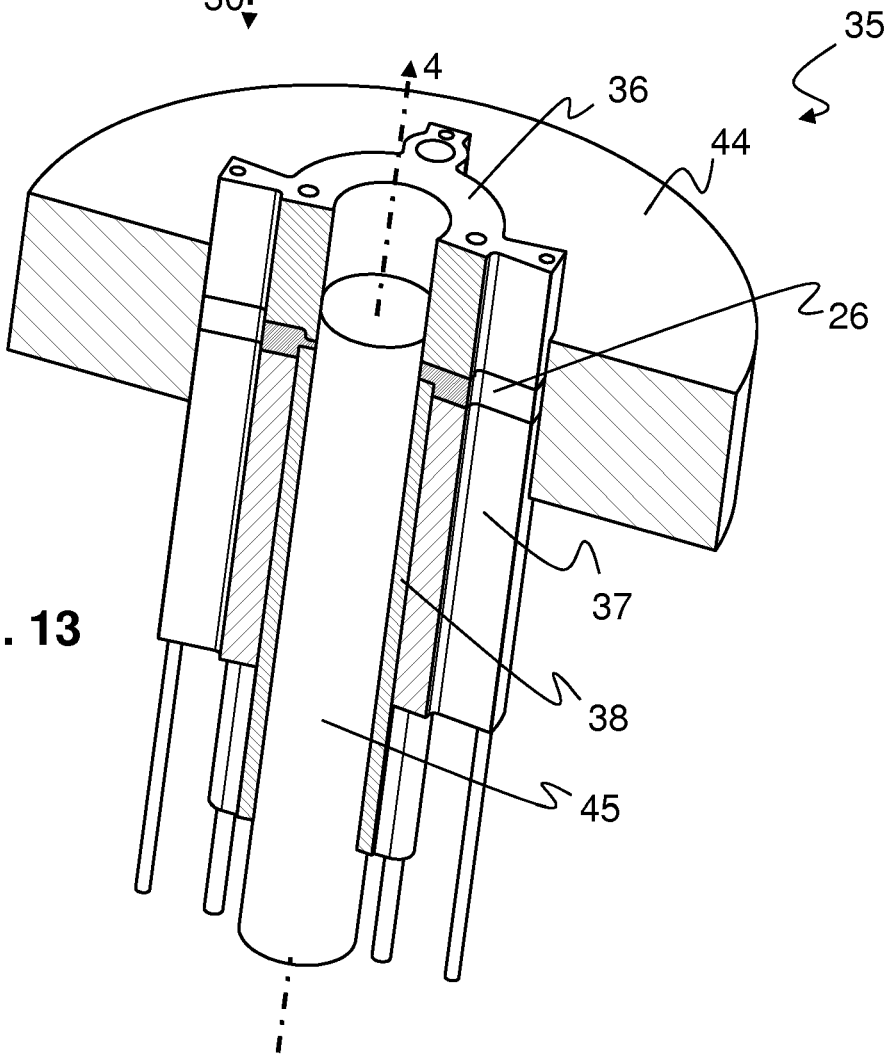
Fig. 13

ROTOR PART OF A ROTOR FOR A CAMSHAFT ADJUSTER AND PRESSING TOOL FOR THE PRODUCTION THEREOF

This application represents the U.S. national stage entry of International Application No. PCT/EP2017/081094 filed Dec. 1, 2017, which claims priority to German Patent Application No. 10 2016 123 580.6 filed Dec. 6, 2016, the disclosure of which is incorporated herein by reference in its entirety and for all purposes.

Camshaft adjusters comprise a stator and a rotor rotatably arranged therein. The rotor can be connected to a camshaft of an internal combustion engine. The rotor has at least one control vane, which extends from an outer casing of the rotor outwardly in the radial direction, wherein the at least one control vane and partition walls of the stator extending inwardly in the radial direction form at least two chambers. A first chamber can be connected via a first outer opening in the rotor to a first fluid duct system and a second chamber via a second outer opening to a second (separate) fluid duct system. Through the fluid duct systems, the chambers can be supplied specifically with a pressurized fluid, so that the rotor turns specifically with respect to the stator according to the pressure relations inside the chambers.

A rotor made by powder metallurgy for a camshaft adjuster is known for example from DE 10 2011 117 856 A1. Here, the one fluid duct system is supplied with the pressurized fluid via openings on an inner casing surface of a first rotor part. The other fluid duct system is supplied with a pressurized fluid via openings on an end surface of the other rotor part.

From DE 10 2013 015 675 A1 there is known a rotor for a camshaft adjuster, wherein the two fluid duct systems are each supplied with the pressurized fluid via openings on the inner casing surfaces of the rotor. For this, the rotor is composed of two sinter-joined pieces, while an insert piece (a third piece) arranged in the radial direction inside the sinter-joined pieces on the camshaft separates the fluid duct systems and at the same time centers the rotor on the camshaft.

Furthermore, rotors for camshaft adjusters are known in which the rotor is designed as a single piece, and the centering of the rotor on the camshaft, the separation of the fluid duct systems and the fluid ducts between the pressurized fluid supply on the camshaft and the chambers are produced by cutting (such as turning, boring, milling).

The known rotors for camshaft adjusters have proven themselves in a functional respect, but they are complex in regard to the configuration of the ducts, the centering surface of the rotor and the sealing surfaces for the separation of the fluid duct systems and can only be produced with very large fabrication and/or assembly expense. Thus, e.g., many parts need to be fabricated with accurate fitting, in order to form the openings for the pressurized fluid in the assembled condition. Oftentimes an after-machining of considerable extent and/or a time-consuming assembly cannot be avoided for a trouble-free function of the rotors.

Given this introduction, the problem which the present invention proposes to solve is to at least partly alleviate or eliminate the problems known in the prior art. In particular, a rotor should be proposed with which a centering of the rotor on a camshaft and the separation of the fluid duct systems by the rotor is realized, while it should be possible to make the rotor by powder metallurgy with slight fabrication expense.

These problems are solved by a first rotor part according to the features of claim 1 and by a rotor according to the features of claim 3. Further, a pressing tool is indicated according to the features of claim 13, by which the first rotor part can also be produced. Advantageous modifications are the subject matter of the dependent claims. The features individually mentioned in the claims may be combined with each other in technologically expedient circumstances and supplemented by illustrative details from the specification and/or details from the figures, where further variant embodiments of the invention are indicated.

For this, a first rotor part of a rotor for a camshaft adjuster is indicated, wherein the first rotor part is configured (substantially) in the form of a disc (or a ring) and extends along an axial direction between a first end face and a second end face and in a radial direction between a first inner casing and a first outer casing. The first end face and the second end face may be designed at least partly (roughly) parallel to each other. The first inner casing may be designed to be at least partly cylindrical. The first outer casing may be designed to be partly cylindrical. The first end face, second end face, first inner casing and/or first outer casing may be designed with indentations and/or protuberances.

The first rotor part has a shoulder on the first inner casing, which extends inward from the first inner casing in the radial direction and encircles it in a circumferential direction, extending in a first axial direction beyond the first end face and forming an outer circumferential surface. In particular, the shoulder forms the sole shape element that protrudes axially beyond the first end face. The encircling shoulder preferably has constantly the same extension in the axial direction. The encircling shoulder is preferably closed radially (fluid-tight). The encircling shoulder is designed as a single part or as a single piece with the rotor part. Another embodiment calls for at least one or more sealing means to stand off in addition from the first end face. For the description of the sealing means and their manufacture, the corresponding remarks in DE 10 2011 117 856 A1 may in particular be cited in their entirety.

The first rotor part has at least one first inner opening, which is arranged on the first inner casing at the side of the shoulder facing away from the first end face and connected by a first fluid duct, extending in the radial direction outwardly from the shoulder through the first rotor part, to the first end face. The first rotor part has preferably 2, 3, 4 or 5 first inner openings. The first inner opening is preferably arranged at the first inner casing immediately adjacent to the encircling shoulder. At the first inner opening there emerges a first fluid duct, which extends preferably behind the encircling shoulder and through the first rotor component and runs as far as a region on the first end face or to the first end face. The course of the first fluid duct starting from the first opening is preferably such that a short fluidic connection is established as far as the first end face, i.e., preferably running mostly in the axial direction (parallel and behind the encircling shoulder). Preferably, all the first openings and corresponding fluid ducts are uniformly distributed in the circumferential direction, in particular they are arranged in opposite pairs and/or are identical in configuration.

The first rotor part is produced as a single piece with the at least one first inner opening (or all first inner openings), the at least one first fluid duct (or all first fluid ducts) and the shoulder by powder metallurgy. Produced by powder metallurgy means in particular that the first rotor part has been made from a metal powder by pressing. In other words, the first rotor part is a pressed powder metal part. Usually this condition is known as a green body. By a subsequent sintering, the strength of the first rotor part can be enhanced.

Preferably, the first rotor part is used as a sintered pressed powder metal part in a camshaft adjuster.

The outer circumferential surface of the shoulder extends in particular coaxially to the axial direction (or cylindrically to the center axis of the first rotor part), so that the first rotor part can be connected e.g. to a second rotor part by shoving the second rotor part along the axial direction onto the outer circumferential surface.

Preferably, at least all first openings and all first fluid ducts of the first rotor part are produced without cutting, especially by pressing during the powder metallurgy fabrication.

The first rotor part in particular comprises at least one portion of a control vane, preferably half of a control vane, in particular a control vane (especially 2, 3, 4 or 5, etc.), which extends from the outer casing of the first rotor part outwardly in a radial direction. Thanks to the at least one control vane (possibly supplemented by another portion of a control vane of a second rotor part), when the first rotor part is arranged in a stator, two chambers are formed in the stator, while a first chamber can be connected via a first outer opening (e.g., on the first outer casing), the first fluid duct and the first inner opening to a pressurized fluid supply, which is provided via the camshaft.

Each control vane is arranged in the camshaft adjuster between two partition walls of the stator, so that a chamber is formed on each side of the control vane. As mentioned above, each chamber is connected via an outer opening to the respective fluid duct system.

The first rotor part comprises a shoulder, which realizes in particular the centering of the first rotor part on the camshaft and on the other hand a separation of the two fluid duct systems (first fluid duct system: first inner opening, first fluid duct, first outer opening; second fluid duct system: second inner opening, second fluid duct, second outer opening), especially by creating a sealing surface with the camshaft.

Further, a rotor of a camshaft adjuster is proposed. The rotor comprises two fluid duct systems for rotatable arrangement in a stator of the camshaft adjuster, wherein each fluid duct system has at least one fluid duct extending from in each case an inner opening at an inner casing of the rotor to an outer opening at an outer casing of the rotor, wherein the fluid ducts extend at least partly in a parting plane of the rotor between a first rotor part and a second rotor part. The first rotor part comprises all of the first inner openings of the first fluid duct system. Moreover, the first rotor part has a shoulder on a first inner casing, which extends inward from the first inner casing in the radial direction and encircles it in a circumferential direction, extending in a first axial direction to the second rotor part, so that the second rotor part can be arranged on an outer circumferential surface of the shoulder coaxially to the first rotor part. The first rotor part has at least one first inner opening, which is arranged on the first inner casing at the side of the shoulder facing away from the second rotor part; wherein at least the first rotor part is produced as a single piece with all first inner openings and first fluid ducts as well as the shoulder by powder metallurgy.

In particular, the fluid ducts extend at least partly into the control vane of the rotor, so that the outer openings are formed not only on the outer casing but also at least partly on the control vane. In such an embodiment, a partition wall of the stator can never entirely close the second openings, so that a filling of the respective chamber between partition wall and control vane can occur regardless of the position of rotor and stator. Another embodiment calls for the fluid ducts to emerge by their outer openings entirely in the respective side wall of the control vane. In this way, it can be provided that the respective side wall comes to bear against a partition wall of the stator.

The first rotor part is designed in particular in the above described manner, so that the remarks in that place can be used in their entirety for its description. The following explanations on the configuration of the rotor part may likewise be used for the description of the individual part.

In particular, the fluid ducts are arranged in the parting plane between the first rotor part and the second rotor part, so that the fluid ducts are formed at least in part on the end faces of the rotor parts. The fluid ducts run preferably in the radial direction in the parting plane.

In this context, reference is made to DE 10 2011 117 856 A1, in which the fluid ducts are formed by depressions in the end faces, which are designated as joining surfaces there. The fluid ducts there are sealed off by sealing means produced with powder metallurgy (protuberances and notches), so that the rotor parts each made as a single piece by powder metallurgy can in particular be assembled to form a rotor with no further machining. For the description of the sealing means and their production, reference can be made in particular to the entire respective explanations of DE 10 2011 117 856 A1.

In particular, the first rotor part has a smallest internal diameter in the region of the shoulder, while the shoulder has a first end surface on a side facing away from the second rotor part and encircling in the circumferential direction between the first inner casing and the smallest internal diameter, bounding the first fluid duct system in the first axial direction. The shoulder has a second end surface toward the second rotor part encircling in the circumferential direction between the outer circumferential surface and the smallest internal diameter, bounding a second fluid duct system in a second axial direction. The end surfaces of the shoulder and the end faces of the first rotor part are preferably oriented (partly) parallel to each other. The first end surface of the shoulder is preferably arranged axially between the end faces of the first rotor part.

Preferably, the first rotor part can be arranged across the shoulder with the smallest internal diameter on a camshaft, so that a sealing surface with the camshaft is formed by an inner shoulder casing surface or the shoulder. The first and the second fluid duct system are separated from each other by the shoulder and the sealing surface.

In particular, the shoulder centers the first rotor part and the second rotor part (via the outer circumferential surface at the shoulder) on the camshaft.

The shoulder may also have different extensions in the axial direction between the first end surface and the second end surface along the circumferential direction. An at least partly increased extension of the shoulder in the axial direction around the circumference may improve the sealing effect of the sealing surface with the camshaft and/or the centering of the rotor parts on the camshaft.

In particular, all first inner openings are staggered in the axial direction relative to the parting plane. Hence, a first fluid duct extends at least partly along the axial direction, so that the first opening situated at an offset relative to the parting plane is connected to the first fluid duct, situated at least partly in the parting plane, and to the first outer opening.

According to one preferred embodiment, the second rotor part is (also) made as a single piece at least with all second inner openings and second fluid ducts by powder metallurgy.

Preferably, at least all second openings and all second fluid ducts of the second rotor part are produced without cutting.

In particular, a rotor of (only) two pieces is proposed, which has been produced (solely) by powder metallurgy or which consists of pressed metal powder parts. In particular, no cutting machining is necessary, so that an easily and economically producible rotor can be provided.

Preferably, the first rotor part and the second rotor part can be joined together in force closure by a press fit between the outer circumferential surface of the shoulder and the second rotor part along the axial direction. In particular for this, the two surfaces forming the press fit are parallel to the axial direction. Force locking connections require a normal force acting on the surfaces being joined. Their mutual shifting is prevented for as long as the countering force produced by static friction is not overcome.

According to another preferred embodiment, the outer circumferential surface of the shoulder has at least one profiling, so that the first rotor part and the second rotor part are joined by form fit in a circumferential direction. For this, the second inner casing of the second rotor part arranged on the outer circumferential surface has a mating shape corresponding to the profiling. Form fitting connections are produced by the intermeshing of at least two connection partners. In this way, the connection partners cannot be loosened, either with or without interrupted force transmission. In other words, in a form fitting connection the one connection partner stands in the way of the other.

A form fitting connection in the circumferential direction may be used e.g. as a positioning aid for the second rotor part, so that a relative rotational position of the second rotor part with respect to the first rotor part is established. As the profiling, at least one protuberance or depression may be provided on the outer circumferential surface, especially one extending (solely) along the axial direction and the radial direction. In particular, the outer circumferential surface (and accordingly the second inner casing) can be designed in the manner of a spline.

According to an especially preferred embodiment, the first rotor part and the second rotor part intersect in the axial direction at least in one further part (of the rotor), in a radial direction outward from the shoulder, and form a (further) press fit (in addition to the press fit on the outer circumferential surface of the shoulder) in this part (of the rotor). In particular, this at least one press fit is formed in the region of the at least one control vane. The arrangement of a further press fit (in addition to the press fit on the outer circumferential surface) in the region of the at least one control vane may serve the purpose of no gap being formed in the parting plane between the first rotor part and the second rotor part during operation of the camshaft adjuster, which would impair the function of the rotor and the camshaft adjuster. This further intersecting in the axial direction may be formed, e.g., by at least one bolt and/or projection on the one rotor part, which extends (partly) into a correspondingly shaped recess in the other rotor part.

Preferably, such bolts or projections are designed as massive parts and are produced together with the respective rotor part in the green phase. In this context, reference is made to DE 10 2009 042 603 A1, in which a method is described for the production of a composite piece, consisting of a component made by powder metallurgy and a massive piece. DE 10 2009 042 603 A1 is cited here in its entirety with regard to the method described there for the production of a composite piece.

Alternatively, such bolts or projections are likewise designed as powder metallurgy components and they are produced together with the corresponding rotor part in the green phase. In this context, reference is made to DE 10 2009 042 598 A1 in which a method is described for the production of a green body consisting of two partial green bodies. DE 10 2009 042 598 A1 is cited here in its entirety with regard to the method described there for the production of a green body.

In particular, it is proposed that the first rotor part and the second rotor part are joined together (solely) by at least one press fit (or several press fits), especially in a captive manner.

Further, a camshaft adjuster is proposed, comprising at least one stator and a rotor arranged rotationally in the stator of the new kind proposed herein. The rotor comprises at least one control vane, which extends outwardly from the outer casing of the rotor in a radial direction, wherein two chambers are formed by the at least one control vane (and by inwardly in the radial direction extending partition walls of the stator, arranged on both sides of the at least one control vane in the circumferential direction), wherein a first chamber can be connected via a first outer opening to the first fluid duct system and a second chamber can be connected via a second outer opening to the second fluid duct system.

Through the fluid duct systems the chambers can be supplied with a pressurized fluid, so that the at least one control vane and thus the rotor is turned relative to the partition walls or the stator. The rotation of the rotor brings about a turning of the camshaft.

A further aspect relates to a pressing tool for producing a first rotor part, in particular for producing the new first rotor part proposed herein.

The first rotor part made by pressing is configured in the form of a disc and extends along an axial direction between a first end face and a second end face and in a radial direction between a first inner casing and a first outer casing. The first rotor part has a shoulder on the first inner casing, which extends inward from the first inner casing in the radial direction and encircles it in a circumferential direction, and has a smallest internal diameter in the region of the shoulder. The shoulder extends in a first axial direction beyond the first end face and forms an outer circumferential surface and has a second end surface encircling in the circumferential direction between the outer circumferential surface and the smallest internal diameter. The first rotor part furthermore has at least one first inner opening, which is arranged on the first inner casing at the side of the shoulder facing away from the first end face and which is connected by a first fluid duct, extending in the radial direction outwardly from the shoulder through the first rotor part, to the first end face.

In order to produce this first rotor part, the pressing tool comprises a plurality of rams, each of which is movable along the axial directions. The pressing tool comprises at least one upper ram, for contacting the second end face, and at least one lower ram, for contacting the first end face. Further, the pressing tool comprises at least one second lower ram, which can travel in the radial direction outside the shoulder and along the first lower ram in order to form the at least one first fluid duct and the at least one first inner opening, while the at least one second lower ram with an inner ram circumferential surface contacts an outer ram circumferential surface of the at least one upper ram in order to form the at least one first inner opening.

The second lower ram slides in the axial direction (jointly or at the same time) by the inner ram circumferential surface along the outer ram circumferential surface, so that in particular no powder can be situated between these ram circumferential surfaces.

The second lower ram (or mandrel) is designed here as a separate ram (i.e., independent of the first lower ram), so that a (separate) controllable compressing of the powder between the end faces of the second lower ram and the at least one upper ram can occur.

By means of the first lower ram, a duct structure can be created in particular in the first rotor part, which directly adjoins the first fluid duct which is created by means of the second lower ram. These together then form at least one portion (preferably all of) a first fluid duct passing through the first rotor part. This can be closed by a corresponding complementary contour in the second rotor part, so that afterwards only the first inner opening and outer opening form a fluid inlet or fluid outlet.

Another embodiment calls for a duct structure of the first fluid duct in the second rotor part to adjoin the first fluid duct in the first rotor part, in turn being covered by the first rotor part. In this way, for example, the first inner opening can be situated in the first rotor part and the corresponding outer outlet can be situated at least partly, preferably entirely, in the second rotor part.

The first (but also the second) fluid duct may have a constant diameter, as well as a change in diameter. The first (but also the second) fluid duct may run orthogonally, as well as at an angle, to the pressing axis. The first (but also the second) fluid duct can make an angle relative to an orthogonal plane with the pressing axis. The fluid duct may also have a slanting course within the orthogonal plane to the pressing axis, for example, so that the outflowing fluid strikes a stator surface with an oblique angle.

In this context, reference is made to WO 2004/112996 A1, in which a method is described for making side openings or slots on a single-piece component, situated orthogonally to a pressing direction. The teaching of WO 2004/112996 A1 in this regard is hereby incorporated in full.

Furthermore, a method is proposed for the production of the first rotor part with the above explained pressing tool, wherein during the pressing of a powder arranged between the at least one upper ram and the lower rams the at least one first lower ram is arranged constantly spaced in the axial direction away from the at least one upper ram, wherein the at least one second lower ram travels along the first lower ram in order to form the at least one first fluid duct and the at least one first inner opening and is arranged overlapping in the axial direction with the at least one upper ram, while the at least one inner opening is formed by the contacting of an inner ram circumferential surface of the at least one second lower ram with an outer ram circumferential surface of the at least one upper ram.

Further, a method is proposed for making the new rotor described herein, involving at least the following steps:

a. powder metallurgy production of the first rotor part involving a sintering of the first rotor part;

b. powder metallurgy production of the second rotor part involving a sintering of the second rotor part;

c. connecting of the first rotor part and the second rotor part by at least the press fit between the outer circumferential surface of the first rotor part and the second rotor part (optionally by further press fits) to form the rotor.

The remarks about the first rotor part, the rotor, the camshaft adjuster and the proposed method and the pressing tool are mutually transferable.

Figure 6:
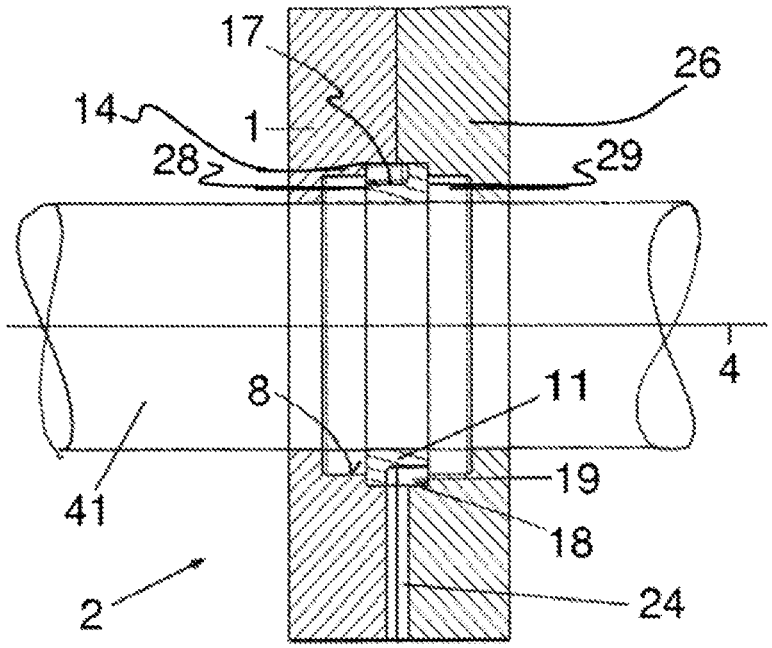
Fig. 6 (Prior Art)
Figure 10:
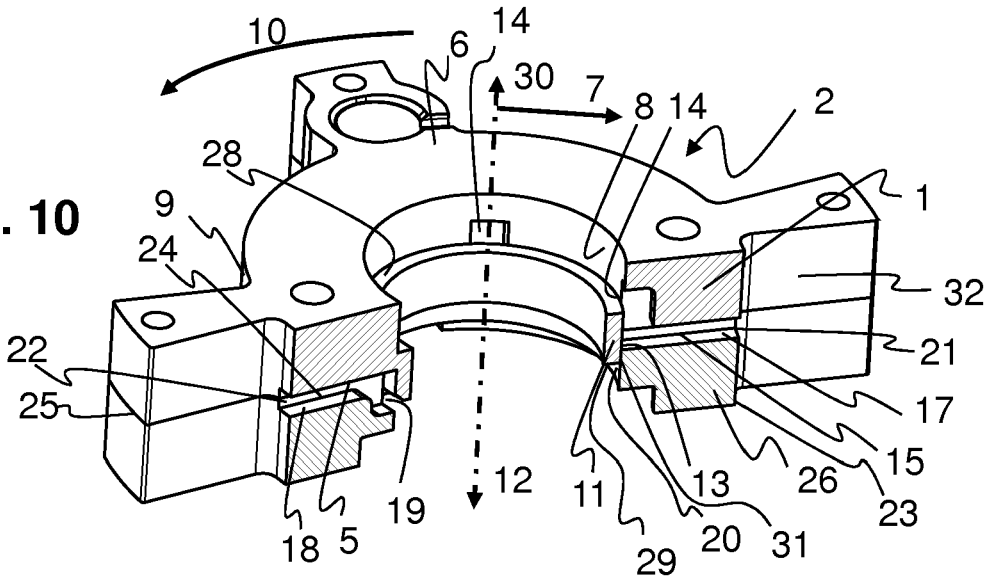
Figure 11:
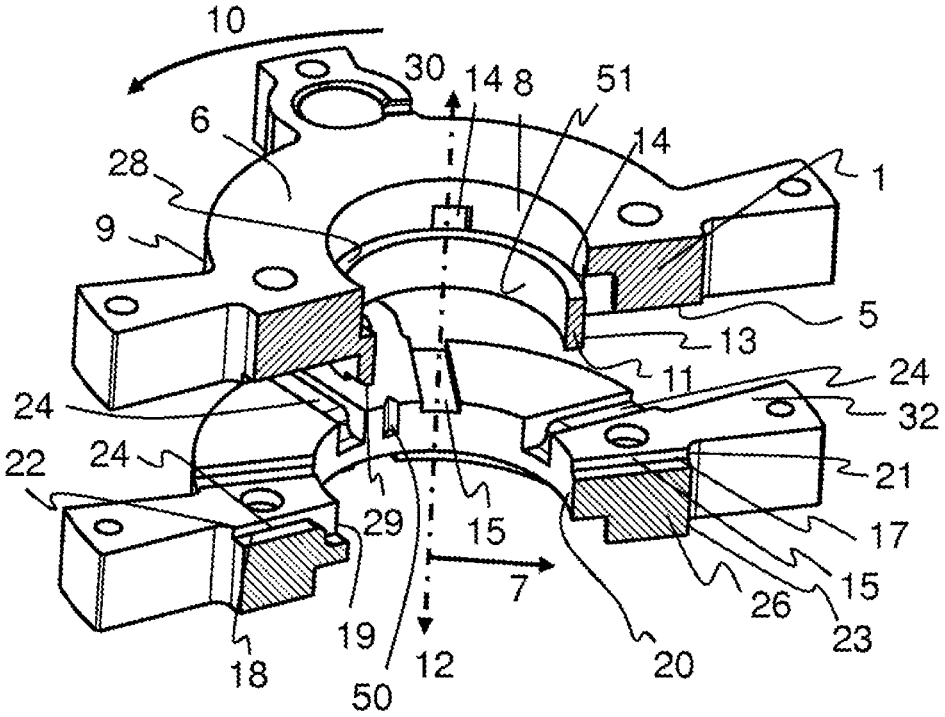
Figure 14:
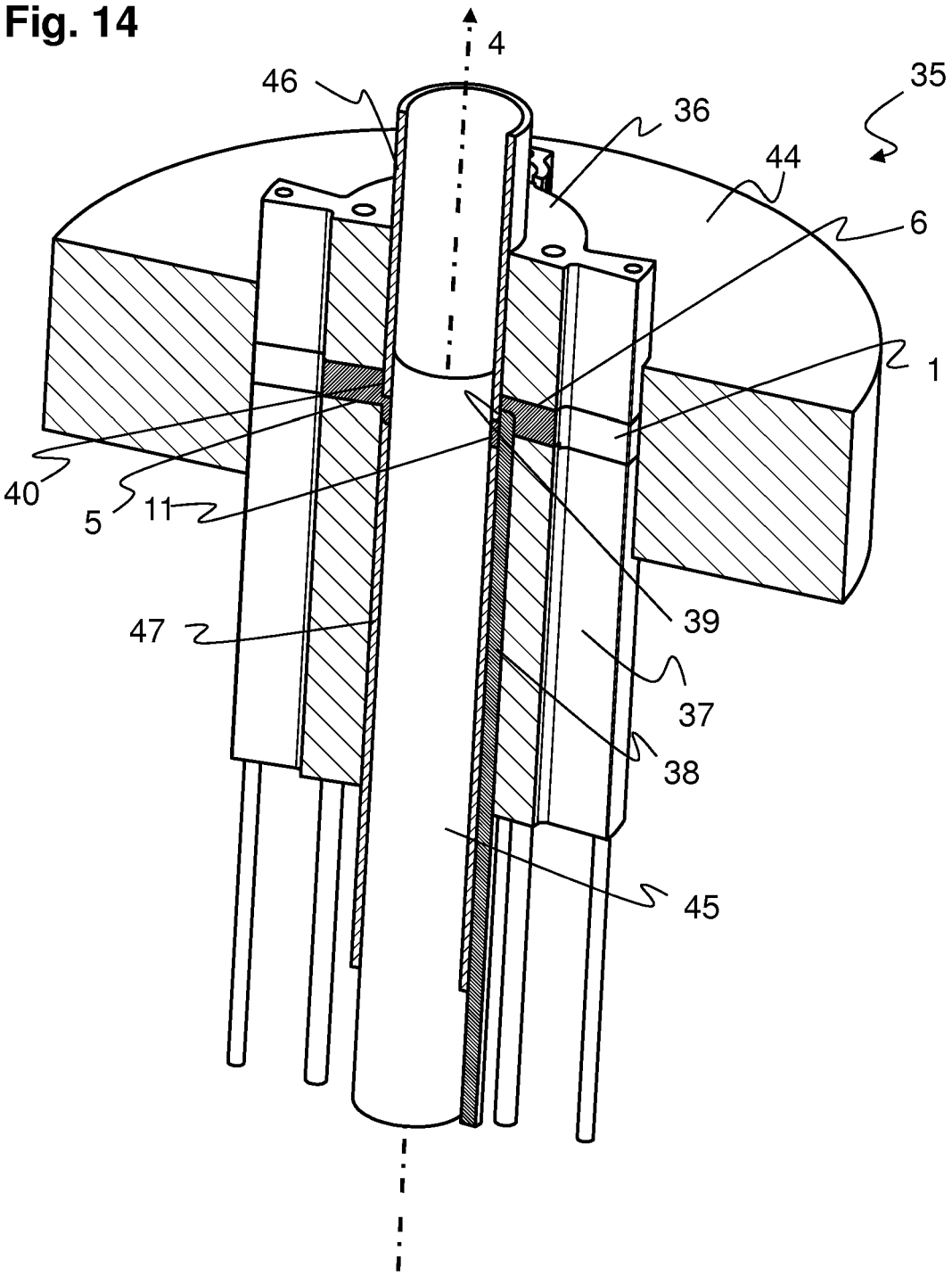

The invention and its technical context shall be explained hereafter with the aid of the figures. The figures show especially preferred exemplary embodiments, although the invention is not confined to them. In particular, it is pointed out that the figures and in particular the size relations shown are only schematic. The same reference numbers designate the same objects. There are shown:

FIG. 1: a known camshaft adjuster according to DE 10 2011 117 856 A1 in a perspective view;

FIG. 2: a known single-piece rotor with openings and fluid ducts produced by cutting, in a perspective view;

FIG. 3: the rotor of FIG. 2 in a top view;

FIG. 4: the cross section shown in FIG. 3 in a partial view;

FIG. 5: a known rotor per DE 10 2013 015 675 A1 in a perspective view, in section;

FIG. 6: the rotor of FIG. 5 arranged on a camshaft in a side view, in section;

FIG. 7: a rotor in a perspective view;

FIG. 8: the rotor of FIG. 7 in a top view;

FIG. 9: the section A-A of FIG. 8 in a side view;

FIG. 10: the rotor of FIGS. 7 to 9 in a perspective view, in section;

FIG. 11: the rotor of FIG. 10 in an exploded representation in a perspective view, in section;

FIG. 12: a first rotor part in a perspective view;

FIG. 13: a pressing tool for making a second rotor part in a perspective view in section; and FIG. 14: a pressing tool for making a first rotor part in a perspective view, in section.

FIG. 1 shows a camshaft adjuster 3 according to DE 10 2011 117 856 A1 in a perspective view. The camshaft adjuster 3 comprises a stator 16 and a rotor 2 arranged rotationally therein. The rotor 2 comprises five control vanes 32, which extend outwardly from the outer casing 9 of the rotor 2 in a radial direction 7, wherein two chambers 33, 34 are formed by the control vanes 32 and by partition walls 42 of the stator 16 extending inward in the radial direction 7 and arranged on both sides of each control vane 32 in the circumferential direction 10. The first chambers 33 can be connected via a first outer opening 21 to the first fluid duct system 17 and the second chambers 34 can be connected via a second outer opening 22 to the second fluid duct system 18. Via the fluid duct systems 17, 18 the chambers 33, 34 can be supplied with a pressurized fluid, so that the control vane 32 and thus the rotor 2 is turned relative to the partition walls 42 or the stator 16. The rotation of the rotor 2 brings about a turning of the camshaft 41.

FIG. 2 shows a known single-piece rotor 2 with openings 14, 19, 21, 22 and fluid ducts 15, 24 of the fluid duct systems 17, 18 produced by cutting, in a perspective view. Here, the rotor 2 comprises four control vanes 32. The first inner openings 14 situated on the inner casing 8 and the first outer openings 21 situated on the outer casing 9 are joined together via first fluid ducts 15 and form the first fluid duct system 17. The second inner openings 19 situated on the inner casing 8 and the second outer openings 22 situated on the outer casing 9 are joined together via second fluid ducts 24 and form the second fluid duct system 18.

FIG. 3 shows the rotor 2 of FIG. 2 in a top view. For its arrangement on a camshaft 41 (not shown), the rotor 2 has a shoulder 11 with a smallest internal diameter 27.

FIG. 4 shows the cross section represented in FIG. 3 in a partial view. Reference is made to the remarks on FIGS. 2 and 3. The rotor 2 has a smallest internal diameter 27 in the region of the shoulder 11, while the shoulder has a first end surface 28 encircling in the circumferential direction 10 between the first inner casing 8 and the smallest internal diameter 27, bounding the first fluid duct system 17 in the first axial direction 12. The shoulder 11 has a second end surface 29 encircling in the circumferential direction 10 on the other side between the inner casing 8 and the smallest internal diameter 27, bounding a second fluid duct system 18 in a second axial direction 30. The rotor 2 can be arranged via the shoulder 11 with the smallest internal diameter 27 on a camshaft 41, so that the shoulder 11 forms a sealing surface with the camshaft 41. Thanks to the shoulder 11 and the sealing surface, the first and the second fluid duct system 17, 18 are separated from each other. The shoulder 11 centers the rotor 2 on the camshaft 41. The centering of the rotor 2 on the camshaft 41, the separating of the fluid duct systems 17, 18 and the fluid ducts 15, 24 between the pressurized fluid supply on the camshaft 41 and the chambers 33, 34 are produced here by cutting (such as turning, boring, milling).

FIG. 5 shows a rotor 2 according to DE 10 2013 015 675 A1 in a perspective view, in section. FIG. 6 shows the rotor 2 of FIG. 5 arranged on a camshaft 41 in a side view, in section. FIGS. 5 and 6 shall be described together in the following. Reference is made to the remarks about FIGS. 2 to 4, regarding the functionality of a rotor 2. In this rotor 2 as well, the two fluid duct systems 17, 18 are each supplied with the pressurized fluid via inner openings 14, 19 on the inner casing surfaces 8, 20 of the rotor 2. For this, the rotor 2 is composed of two sintered joining parts (first rotor part 1 and second rotor part 26), while an insert part (a third part), which is arranged in the radial direction 7 inside the sintered joining parts on the camshaft 41 and forms a shoulder 11, separates the fluid duct systems 17, 18 and at the same time centers the rotor 2 on the camshaft 41.

FIG. 7 shows a rotor 2 in a perspective view. The rotor 2 comprises four control vanes 32 and has a two-piece design. Along a parting plane 25, a first rotor part 1 is arranged on one side and a second rotor part 26 on the other side to form the rotor 2, the two parts being connected to each other. The first inner openings 14 arranged on the first inner casing 8 and first outer openings 21 arranged on the first outer casing 9 are joined together by first fluid ducts 15 and form the first fluid duct system 17. The second inner openings 19 arranged on the second inner casing 20 and second outer openings 22 arranged on the second outer casing 23 are joined together by second fluid ducts 24 and form the second fluid duct system 18. The rotor 2 has a shoulder 11, while the shoulder 11 forms a second end surface 29 encircling in the circumferential direction 10.

FIG. 8 shows the rotor 2 of FIG. 7 in a top view. For its arrangement on a camshaft 41 (not shown), the rotor 2 has a shoulder 11 with a smallest internal diameter 27.

FIG. 9 shows the cross section A-A of FIG. 8 in a side view. The rotor 2 has a two-piece design, both rotor parts 1, 26 having the shape of a disc. The first rotor part 1 extends along an axial direction 4, 12, 30 between a first end face 5 and a second end face 6 and in a radial direction 7 between a first inner casing 8 and a first outer casing 9.

The rotor 2 comprises two fluid duct systems 17, 18 for its rotatable arrangement in a stator 16 of the camshaft adjuster 3, each fluid duct system 17, 18 having a fluid duct 15, 24 extending respectively from an inner opening 14, 19 on an inner casing 8, 20 of the rotor 2 to an outer opening 21, 22 on an outer casing 9, 23 of the rotor 2 (here only the second fluid duct system 18 is shown). The fluid ducts 15, 24 extend at least partly in a parting plane 25 of the rotor 2 between a first rotor part 1 and a second rotor part 26. The first rotor part 1 comprises all first inner openings 14 of the first fluid duct system 17.

Furthermore, the first rotor part 1 has a shoulder 11 on the first inner casing 8, which extends inward from the first inner casing 8 in the radial direction 7 and encircles it in a circumferential direction 10, extending in a first axial direction 12 up to the second rotor part 26, so that the second rotor part 26 is arranged on an outer circumferential surface 13 of the shoulder 11 coaxially with the first rotor part 1. The first rotor part 1 has a plurality of first inner openings 14, which are arranged on the first inner casing 8 at the side of the shoulder 11 facing away from the second rotor part 26.

The first rotor part 1 has a smallest internal diameter 27 in the region of the shoulder 11. The shoulder 11 has a first end surface 28 on a side facing away from the second rotor part 26 and encircling in the circumferential direction 10 between the first inner casing 8 and the smallest internal diameter 27, bounding the first fluid duct system 17 in the first axial direction 12. The shoulder 11 has a second end surface 29 toward the second rotor part 26, encircling in the circumferential direction 10 between the outer circumferential surface 13 and the smallest internal diameter 27, bounding a second fluid duct system 18 in a second axial direction 30.

The first rotor part 1 can be arranged via the shoulder 11 with the smallest internal diameter 27 on a camshaft 41 (not shown, see FIG. 6 for this), so that the shoulder 11 (or its internal shoulder casing surface 51) forms a sealing surface with the camshaft 41. Thanks to the shoulder 11 and the sealing surface, the first and the second fluid duct system 17, 18 are separated from each other. The shoulder 11 centers the first rotor part 1 and the second rotor part 26 (via the outer circumferential surface 13 on the shoulder 11) on the camshaft 41. The shoulder 11 may also have different extensions in the axial direction 4, 12, 30 between the first end surface 28 and the second end surface 29 along the circumferential direction 10. Here, the first end surface 28 and the second end surface 29 run parallel to each other. But a departure from a mutually parallel running is also possible. An at least partly enlarged extension of the shoulder 11 in the axial direction 4, 12, 30 may improve the sealing effect of the sealing surface with the camshaft 41 as well as the centering of the rotor parts 1, 26 on the camshaft 41.

The first rotor part 1 and the second rotor part 26 can be joined to each other with force locking by a press fit 31 between the outer circumferential surface 13 and the second rotor part 26 along the axial direction 4, 12, 30. Both surfaces forming the press fit 31.1 (the outer circumferential surface 13 and the surface of the second rotor part 26) run parallel to the axial direction 4, 12, 30.

The first rotor part 1 and the second rotor part 26 intersect in the axial direction 4, 12, 30 in one further part of the rotor 2, in a radial direction 7 outward from the shoulder 11, and form a further press fit 31.2 (in addition to the press fit 31.1 on the outer circumferential surface 13) in this part of the rotor 2. This further press fit 31.2 is formed in the region of the control vane 32. Preferably, each control vane 32, as long as it has a parting plane, is secured by a further press fit 31.2.

The situation of a further press fit 31.2 (in addition to the press fit 31.1 on the outer circumferential surface 13) in the region of the control vane 32 ensures that no gap is formed during the operation of the camshaft adjuster 3 in the parting plane 25 between the first rotor part 1 and the second rotor part 26 in the region of the control vane 32, which might at least impair the function of the rotor 2 and the camshaft adjuster 3.

This further intersection in the axial direction 4, 12, 30 is formed here by a bolt 43 arranged in the second rotor part 26, which extends into a correspondingly shaped recess 48 in the first rotor part 1. The bolt 43 may be inserted afterwards or it may be produced as described above, by a method as described in DE 10 2009 042 603 A1. Alternatively, as well as additionally to a separate bolt 43, a corresponding bolt 43 can be formed on the first rotor part 1 and/or on the second rotor part 26 by a green-in-green method, as described above.

FIG. 10 shows the rotor 2 of FIGS. 7 to 9 in a perspective view, in section. FIG. 11 shows the rotor 2 of FIG. 10 in an exploded drawing in perspective view, in section. Reference is made to the remarks for FIG. 9. FIGS. 10 and 11 shall be described together in the following.

The outer circumferential surface 13 of the shoulder 11 of the first rotor part 1 here has a profiling 49 (concealed here, see FIG. 12), so that the first rotor part 1 and the second rotor part 26 are joined by form fitting in a circumferential direction 10. The second inner casing 20 of the second rotor part 26 arranged on the outer circumferential surface 13 has a mating shape 50 corresponding to the profiling 49 for this purpose. The form fitting connection in the circumferential direction 10 is used here as a positioning aid for the second rotor part 26, so that a relative rotational position of the second rotor part 26 is established with respect to the first rotor part 1.

All first inner openings 14 are arranged here staggered with respect to the parting plane 25 in the axial direction 4, 12, 30. Thus, a first fluid duct 15 extends at least for a portion along the axial direction 4, 12, 30, so that the first inner opening 14 arranged with an offset to the parting plane 25 is connected to the first fluid duct 15 arranged at least partly in the parting plane 25 and the first outer opening 21.

The fluid ducts 15, 24 of the fluid duct systems 17, 18 here are all arranged in the parting plane 25 between the first rotor part 1 and the second rotor part 26, so that the fluid ducts 15, 24 are formed at least partly at the end faces (on the first end face 5 of the first rotor part 1) of the rotor parts 1, 26.

FIG. 12 shows a first rotor part 1 in a perspective view. Reference is made to the remarks for FIGS. 9 to 11.

The outer circumferential surface 13 of the shoulder 11 of the first rotor part 1 here has a profiling 49, so that the first rotor part 1 and the second rotor part 26 are joined by form fitting in a circumferential direction 10. The profiling 49 engages with a mating shape 50 arranged on the second rotor part 26 (concealed here, see FIG. 10).

In addition to the press fit 31 with the second rotor part 26 on the outer circumferential surface 13 of the first rotor part 1, bolts 43 are arranged here in each control vane 32 of the first rotor part 1, forming further press fits 31 with corresponding recesses 48 in the second rotor part 26.

FIG. 13 shows a pressing tool 35 for the production of a second rotor part 26 in a perspective view, in section. For the production of the second rotor part 26, the pressing tool 35 comprises a plurality of rams 36, 37, 38, each of which is movable along the axial directions 4. The pressing tool 35 comprises at least one upper ram 36 and at least one first lower ram 37. Moreover, the pressing tool 35 comprises a second lower ram 38, which is used to form, e.g., different material thicknesses (along the axial direction 4). The rams 36, 37, 38 are arranged around a center mandrel 45 and inside a die 44 during the pressing process.

FIG. 14 shows a pressing tool 35 for the production of a first rotor part 1 in a perspective view, in section. For the production of the first rotor part 1, the pressing tool 35 comprises a plurality of rams 36, 37, 38, 46, 47, each of which is movable along the axial directions 4. The pressing tool 35 comprises at least one upper ram 36, for contacting the second end face 6 of the first rotor part 1, and at least one first lower ram 37, for contacting the first end face 5. Moreover, the pressing tool 35 comprises at least one second lower ram 38, which can travel in the radial direction 7 outside the shoulder 11 and along the first lower ram 37 in order to form the at least one first fluid duct 15 and the at least one first inner opening 14. The at least one second lower ram 38 with an inner ram circumferential surface 39 contacts an outer ram circumferential surface 40 of the second upper ram 46 in order to form the at least one first inner opening 14.

The rams 36, 37, 38, 46, 47 are arranged around a center mandrel 45 and inside a die 44 during the pressing process.

The second lower ram 38 slides during the pressing process in the axial direction 4 by the inner ram circumferential surface 39 along the outer ram circumferential surface 40, so that no powder can get between these ram circumferential surfaces 39, 40.

The second lower ram 38 (or mandrel) is designed here as an independent ram (i.e., independent of the first lower ram 37), so that a controllable compressing of the powder between the end faces of the second lower ram 38 and the upper ram 36 may occur.

In the method for the production of the first rotor part 1 with the pressing tool 35, during a pressing of a powder arranged between the upper rams 36, 46 and the lower rams 37, 38, 47 the first lower ram 37 is arranged constantly spaced in the axial direction 4 away from the upper ram 36, wherein the at second lower ram 38 travels along the first lower ram 37 (and the third lower ram 47) in order to form the at least one first fluid duct 15 and the at least one first inner opening 14 and is arranged overlapping in the axial direction 4 with the second upper ram 46, while the at least one inner opening 14 is formed by the contacting of an inner ram circumferential surface 39 of the second lower ram 38 with an outer ram circumferential surface 40 of the second upper ram 46. The shoulder 11 is formed by the second upper ram 46 and the third lower ram 47. A further course of the first fluid duct 15, which adjoins the first fluid duct 15 formed by the second lower ram 38 and connects the first inner opening 14 to the first outer opening 21, is formed for example in the first rotor part 1 by means of the first lower ram 37.

LIST OF REFERENCE SYMBOLS

1 First rotor part
2 Rotor
3 Camshaft adjuster
4 Axial direction
5 First end face
6 Second end face
7 Radial direction
8 First inner casing
9 First outer casing
10 Circumferential direction
11 Shoulder
12 First axial direction
13 Outer circumferential surface
14 First inner opening
15 First fluid duct
16 Stator
17 First fluid duct system
18 Second fluid duct system
19 Second inner opening
20 Second inner casing
21 First outer opening
22 Second outer opening
23 Second outer casing
24 Second fluid duct
25 Parting plane

26 Second rotor part
27 Smallest internal diameter
28 First end surface
29 Second end surface
30 Second axial direction
31 Press fit (31.1 and 31.2)
32 Control vane
33 First chamber
34 Second chamber
35 Pressing tool
36 (First) Upper ram
37 First lower ram
38 Second lower ram
39 Inner ram circumferential surface
40 Outer ram circumferential surface
41 Camshaft
42 Partition wall
43 Bolt
44 Die
45 Center mandrel
46 Second upper ram
47 Third lower ram
48 Recess
49 Profiling
50 Mating shape
51 Internal shoulder casing surface

The invention claimed is:

1. A first rotor part of a rotor for a camshaft adjuster, wherein the first rotor part is configured in a form of a disc extending between a first end face and a second end face in an axial direction and extending between a first inner casing and a first outer casing in a radial direction, the first rotor part comprising:

an annular shoulder on the first inner casing, the shoulder extending inward from the first inner casing in the radial direction and extending beyond the first end face in the axial direction so as to form an outer circumferential surface; and a first fluid duct extending outwardly from the shoulder through the first rotor part in the radial direction, wherein the first inner casing further includes at least one first inner opening at a side of the shoulder facing away from the first end face, the at least one first inner opening fluidly connected to the first end face via the first fluid duct, wherein the first rotor part is produced as a single piece by powder metallurgy.

2. The first rotor part according to claim 1, wherein the at least one first inner opening and the first fluid duct are produced without cutting.

3. A rotor for rotatable arrangement in a stator of a camshaft adjuster, the rotor comprising:

the first rotor part according to claim 1, wherein the shoulder of the first rotor part extends axially into a second rotor part such that the second rotor part is arranged on the outer circumferential surface of the shoulder.

4. The rotor according to claim 3, wherein the shoulder defines a smallest internal diameter of the first rotor part, wherein the shoulder includes an annular first end surface on the side of the shoulder facing away from the first end face extending between the first inner casing and the smallest internal diameter, the first end surface bounding the first fluid duct in the axial direction, wherein the shoulder further includes an annular second end surface on a side facing toward the second rotor part extending between the outer circumferential surface and the smallest internal diameter, and wherein the second rotor part includes:

a second inner casing including a second inner opening; and a second fluid duct extending radially outwardly from the second inner opening through the second rotor part, wherein the second end surface bounds the second fluid duct in the axial direction.

5. The rotor according to claim 3, wherein the second rotor part is made as a single piece by powder metallurgy.

6. The rotor according to claim 4, wherein the second inner opening and the second fluid duct, are produced without cutting.

7. The rotor according to claim 3, wherein the first rotor part and the second rotor part are joined in force closure by a press fit between the outer circumferential surface of the shoulder and the second rotor part along the axial direction.

8. The rotor according to claim 7, wherein the first rotor part and the second rotor part are joined at a further press fit in a location radially outward from the shoulder.

9. The rotor according to claim 8, wherein the rotor further comprises at least one control vane extending radially outward from an outer casing of the rotor wherein the further press fit is formed at the at least one control vane.

10. The rotor according to claim 3, wherein the outer circumferential surface includes at least one profiling configured to join the first rotor part and the second rotor part by form fit in a circumferential direction.

11. A camshaft adjuster comprising:

a stator; and the rotor according to claim 3, the rotor rotatably arranged in the stator, wherein the second rotor part includes:

a second inner casing including a second inner opening; and a second fluid duct extending radially outwardly from the second inner opening through the second rotor part, wherein the rotor further comprises at least one control vane, extending radially outward from at least one of the first outer casing and a second outer casing of the second rotor part toward the stator, wherein the at least one control vane divides a space within the stator into a first chamber and a second chamber, wherein the first chamber is connected to the first fluid duct and the second chamber is connected to the second fluid duct.

12. A method for producing the rotor according to claim 3, the method comprising:

sintering the first rotor part;

sintering the second rotor part; and connecting of the first rotor part and the second rotor part by at least one press fit between the outer circumferential surface and the second rotor part so as to form the rotor.

13. A pressing tool for producing a first rotor part, configured in a form of a disc extending between a first end face and a second end face in an axial direction and extending between a first inner casing and a first outer casing in a radial direction the first rotor part including an annular shoulder on the first inner casing, the shoulder extending inward from the first inner casing in the radial direction so as to define a smallest internal diameter of the first rotor part, the shoulder further extending beyond the first end face in the axial direction so as to form an outer circumferential surface and an annular second end surface extending between the outer circumferential surface and the smallest internal diameter, the first rotor part further including a first fluid duct extending outwardly from the shoulder through the first rotor part in the radial direction and at least one first inner opening arranged on the first inner casing at a side of the shoulder facing away from the first end face, the at least one first inner opening fluidly connected to the first end face via the first fluid duct, the pressing tool comprising:

a plurality of rams, each ram configured to move along the axial direction, the plurality of rams including:

at least one upper ram, configured to contact the second end face, at least one first lower ram, configured to contact the first end face and at least one second lower ram, configured to travel along the at least one first lower ram, wherein an inwardly-facing ram surface of the at least one second lower ram is configured to contact an outwardly-facing ram circumferential surface of the at least one upper ram.

14. A method for producing a first rotor part with the pressing tool according to claim 13, the method comprising:

moving the at least one upper ram and the at least one first lower ram towards one another;

moving the at least one second lower ram along the at least one first lower ram such that the inwardly-facing ram surface of the at least one second lower ram travels along and contacts the outwardly-facing ram circumferential surface of the at least one upper ram; and pressing a powder between the at least one upper ram, the at least one first lower ram, and the at least one second lower ram so as to compact the powder and form the first rotor part;

wherein, during the pressing:

forming a second end face of the first rotor part with the at least one upper ram, forming a first end face of the first rotor part with the at least one first lower ram, forming an annular shoulder of the first rotor part with the at least one upper ram and the at least one first lower ram, forming a first fluid duct and at least one first inner opening of the first rotor part with the at least one upper ram, the at least one first lower ram, and the at least one second lower ram.

* * * * *